US007765638B2

(12) United States Patent
Pineschi et al.

(10) Patent No.: US 7,765,638 B2
(45) Date of Patent: Aug. 3, 2010

(54) HYBRID VACUUM CLEANER NOZZLE

(75) Inventors: Massimiliano Pineschi, Villanova (IT); Riccardo Roschi, Varese (IT)

(73) Assignee: New Ermes Europe S.p.A., Albizzate (Barese) (IT)

( * ) Notice: Subject to any disclaimer, the term of this patent is extended or adjusted under 35 U.S.C. 154(b) by 37 days.

(21) Appl. No.: 11/916,676

(22) PCT Filed: Jun. 13, 2006

(86) PCT No.: PCT/EP2006/005634

§ 371 (c)(1),
(2), (4) Date: Dec. 15, 2008

(87) PCT Pub. No.: WO2006/133886

PCT Pub. Date: Dec. 21, 2006

(65) Prior Publication Data

US 2009/0133213 A1 May 28, 2009

(30) Foreign Application Priority Data

Jun. 14, 2005 (IT) ..... MO2005A0151

(51) Int. Cl.
*A47L 9/04* (2006.01)

(52) U.S. Cl. ..... 15/377; 15/387; 15/415.1; 15/DIG. 1

(58) Field of Classification Search ..... 15/377, 15/383–389, 415.1, 419, DIG. 1; *A47I 9/02, A47I 9/04*

See application file for complete search history.

(56) References Cited

U.S. PATENT DOCUMENTS

| | | | |
|---|---|---|---|
| 2,915,774 | A | 12/1959 | Darrow |
| 5,875,517 | A | 3/1999 | Fust et al. |

FOREIGN PATENT DOCUMENTS

| | | |
|---|---|---|
| AT | 383 264 | 6/1987 |
| DE | 199 12 651 | 9/2000 |
| JP | 08 322766 | 4/1997 |
| WO | 99/65376 | 12/1999 |

OTHER PUBLICATIONS

International search Report mailed Sep. 25, 2006.
Written Opinion of the International Searching Authority dated Sep. 25, 2006.

*Primary Examiner*—David A Redding
(74) *Attorney, Agent, or Firm*—Nixon & Vanderhye, P.C.

(57) ABSTRACT

It is disclosed a vacuum cleaner nozzle comprising a housing, a rotatable brush which is adapted to brush a surface, and a turbine, wherein a suction air flow impacting on said turbine generates a first rotational torque for rotating said rotatable brush, wherein it further comprises an electric power generator for generating electric power by a rotation of said turbine; an accumulator unit for storing said electric power; and an electric motor which is adapted to generate a second rotational torque for rotating said rotatable brush, wherein said electric motor is electrically connected to said accumulator unit. The electric power generator and the electric motor could be either integrated into a single component or they could be separate components.

21 Claims, 6 Drawing Sheets

HYBRID VACUUM CLEANER NOZZLE

This application is the U.S. national phase of International Application No. PCT/EP2006/005634 filed 13 Jun. 2006 which designated the U.S. and claims priority to IT MO2005A 000151 filed 14 Jun. 2005, the entire contents of each of which are hereby incorporated by reference.

TECHNICAL FIELD

The present invention generally relates to vacuum cleaners and in particular to a vacuum cleaner nozzle.

BACKGROUND ART

Several vacuum cleaners are known in the art, both for domestic use and for industrial use. They typically have a body which houses internally a motor unit which produces the suction effect, a filter unit situated ahead of the motor and an element for collecting the sucked-up material in the form of a collector chamber or a bag.

Typically, the motor unit is connected to the exterior of the body by means of a tube which has one end engaged inside an opening provided in the body and an opposite end which terminates in a mouth on which various accessories may be alternately fitted in order to adapt the sucking action to the surfaces to be treated.

These accessories include suction cleaner nozzles. A suction cleaner nozzle typically comprises a housing which is provided in the upper zone with an engaging opening for the mouth of the tube. The housing houses a rotatable drum which has peripherally a plurality of bristles distributed in a predefined arrangement and intended to brush the surface to be treated and conveying the collected material towards the opening and thus towards the tube. The drum provided with the plurality of bristles is also termed rotatable brush.

Rotation of the rotatable brush can be performed in various ways.

According to a first solution, the housing has, mounted inside it, an electric motor having, projecting therefrom, a rotatable shaft which is connected, for example by means of an endlessly wound drive belt, to the rotatable brush so as to transmit a rotational movement to the rotatable brush.

Powering of the electric motor may be performed by means of the power line or by means of batteries.

According to a second known solution, rotation of the rotatable brush is performed by means of a turbine which is mounted opposite the opening of the housing.

The suction action produced by the motor unit generates an air flow conveyed towards the turbine which causes rotation thereof. The turbine is connected to the rotatable brush by means of an endlessly wound drive belt and transmits the rotational movement to the rotatable brush.

The known solutions for powering the electrical motor have certain drawbacks.

A first drawback is that the electric power supply from the power line requires a connection between the latter and the electric motor by means of electric cables which, therefore, hinder the user during use of the vacuum cleaner.

Another drawback is that powering by means of batteries requires cyclical recharging of the latter, during which the vacuum cleaner nozzle cannot be used; moreover, the batteries require an expensive and cumbersome recharging equipment.

A further drawback is that powering by means of turbines moved by the suction air flow supplies a substantially low rotational torque to the drum: this causes in given circumstances, for example, during use of the vacuum cleaner on rugs or carpets with long pile, a substantial reduction in the speed of rotation of the rotatable brush. In some cases, the speed is reduced to the point of seizing thereof, owing to the strong adhesion or possible intertwining which occurs between the bristles and the pile of the surface being treated and with a consequent substantial reduction in the suction efficiency.

OBJECT AND SUMMARY OF THE INVENTION

An object of the invention is to improve the vacuum cleaner nozzles according to the state of the art. In particular, an object of the invention is to provide a vacuum cleaner nozzle which allows the treatment of surfaces of any type without there being a reduction in the suction efficiency while eliminating any cable connections to an electrical power line and which may operate substantially without interruption.

According to a first aspect, the present invention provides a vacuum cleaner nozzle comprising a housing, a rotatable brush, and a turbine. When a suction air flow impacts on the turbine, it generates a first rotational torque for rotating the rotatable brush. The nozzle further comprises an electric power generator for generating electric power by the rotation of the turbine; an accumulator unit for storing the generated electric power; and an electric motor which is adapted to generate a second rotational torque for rotating the rotatable brush. The electric motor is electrically connected to the accumulator unit.

The electric power generator and the electric motor may be integrated into a single component or they could be separated components. In this last case, they could be substantially identical devices (for instance an electric motor which is caused to operate as motor or as generator).

Profitably, the nozzle further comprises a detector device for detecting values of at least one parameter indicative of the rotation of the rotatable brush. In one embodiment, the detector device may comprise an encoder and the at least one parameter may comprise a number of revolutions per time unit and/or an angular speed of said turbine. In another embodiment, the detector device may comprise a resistive torque detector and the at least one parameter may comprise a resistive torque on said turbine.

Preferably, the nozzle further comprises a switching device (for instance a board with components mounted thereon) for switching between a first operation mode and a second operation mode. In the first operation mode the electric power generator generates electric power which is stored in the accumulator unit. In the second operation mode the electric motor is working, fed by the stored electric power.

The switching device may be adapted to store a first threshold value and a second threshold value of the parameter indicative of the rotation of the rotatable brush.

The switching device may be adapted to compare the plurality of detected values of the at least one parameter with the first threshold value and the second threshold value and to switch between the first operation mode and the second operation mode according to results of said comparing.

When the electric power generator and the motor are separated components, profitably, they could be connected to a shaft of the turbine at opposite sides of the turbine.

In one convenient embodiment, at least one of the electric power generator and the electric motor is arranged with its axis parallel to a shaft of the turbine, and it is connected to the shaft by means of a gearing. The gear ratio between the at least one of said electric power generator and the electric motor and the shaft is comprised between 1:3 and 3:1.

In one embodiment, the accumulator unit comprises at least one capacitor.

In one preferred embodiment, the accumulator unit comprises at least one ultracapacitor.

The nozzle according to one embodiment of the invention may also comprise a further rotatable brush. The rotatable brush and the further rotatable brush may have a same rotation direction or opposite rotation directions.

According to another aspect, the present invention relates to a vacuum cleaner nozzle comprising a housing, a rotatable brush, and a turbine. The suction air flow impacting on said turbine generates a first rotational torque for rotating the rotatable brush. The nozzle further comprises: a motor generator unit which is adapted to generate electric power by a rotation of said turbine when it operates in generator mode and to generate a second rotational torque for rotating the rotatable brush when it operates in motor mode, and an accumulator unit for storing the electric power generated by the motor generator unit in its motor mode. The motor generator unit is electrically connected to the accumulator unit (18).

According to a third aspect the present invention provides a vacuum cleaner comprising a vacuum cleaner nozzle as set forth above in connection with the first or the second aspect.

BRIEF DESCRIPTION OF THE DRAWINGS

Further features and advantages of the invention will emerge more clearly from the following description, provided by way of a non-limiting example, to be read with reference to the attached drawings wherein.

DETAILED DESCRIPTION OF PREFERRED EMBODIMENTS OF THE INVENTION

Figure 1:
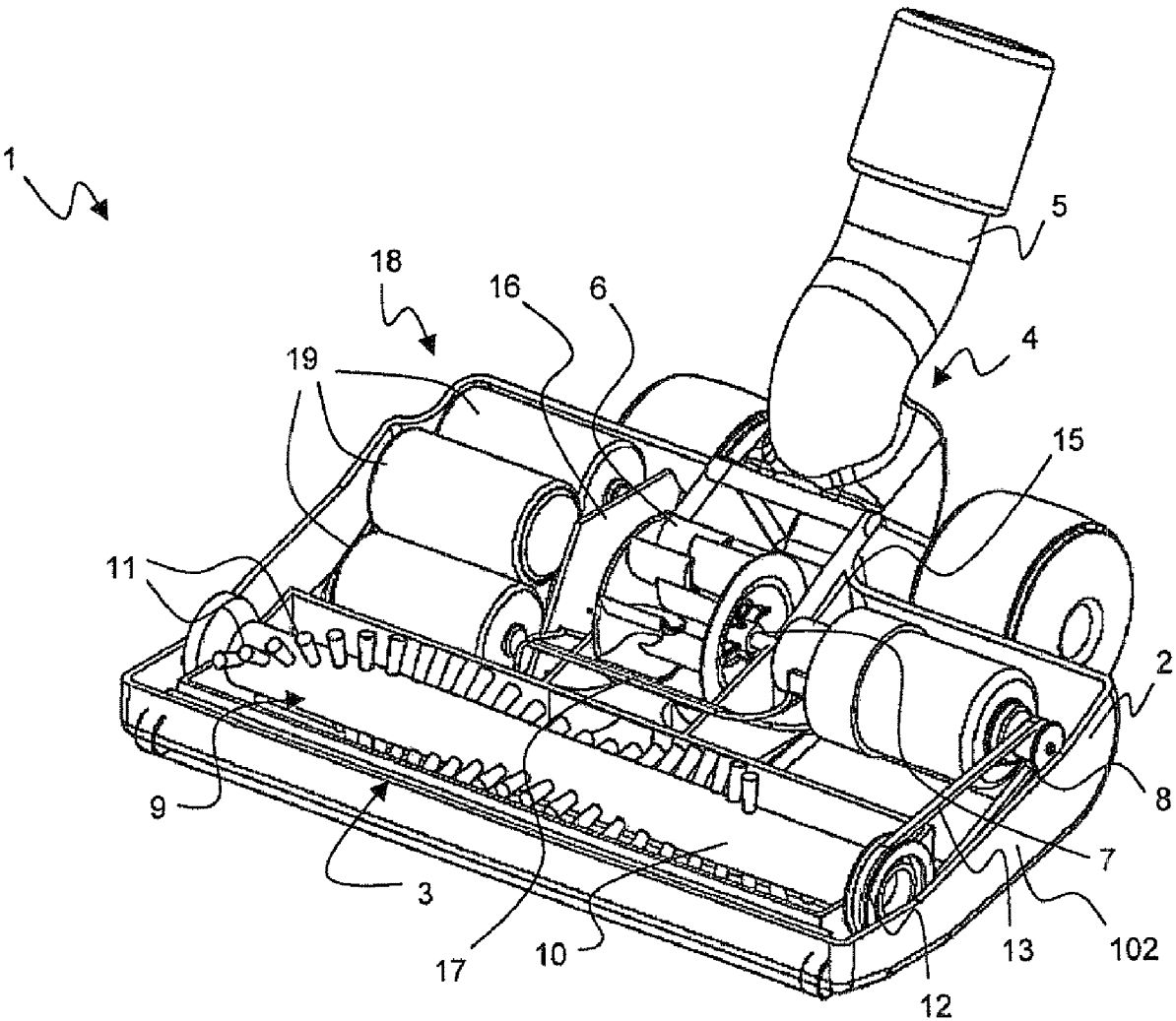
FIG. 1 is a perspective view of a vacuum cleaner nozzle devoid of the bottom portion, according to a first embodiment of the present invention.

In FIG. 1, the reference numeral 1 denotes a vacuum cleaner nozzle which can be fitted on the terminal end of a conventional suction tube extending therefrom.

The vacuum cleaner nozzle 1 comprises a housing 2 which has a first opening 3 directed towards the surface to be brushed and a second opening 4. The second opening 4 is provided with an articulated end-piece 5 which extends towards the outside so as to allow engagement of an end of a suction tube of a vacuum cleaner (not shown in FIG. 1), which can be both of the domestic type and of the industrial type.

Figure 2:
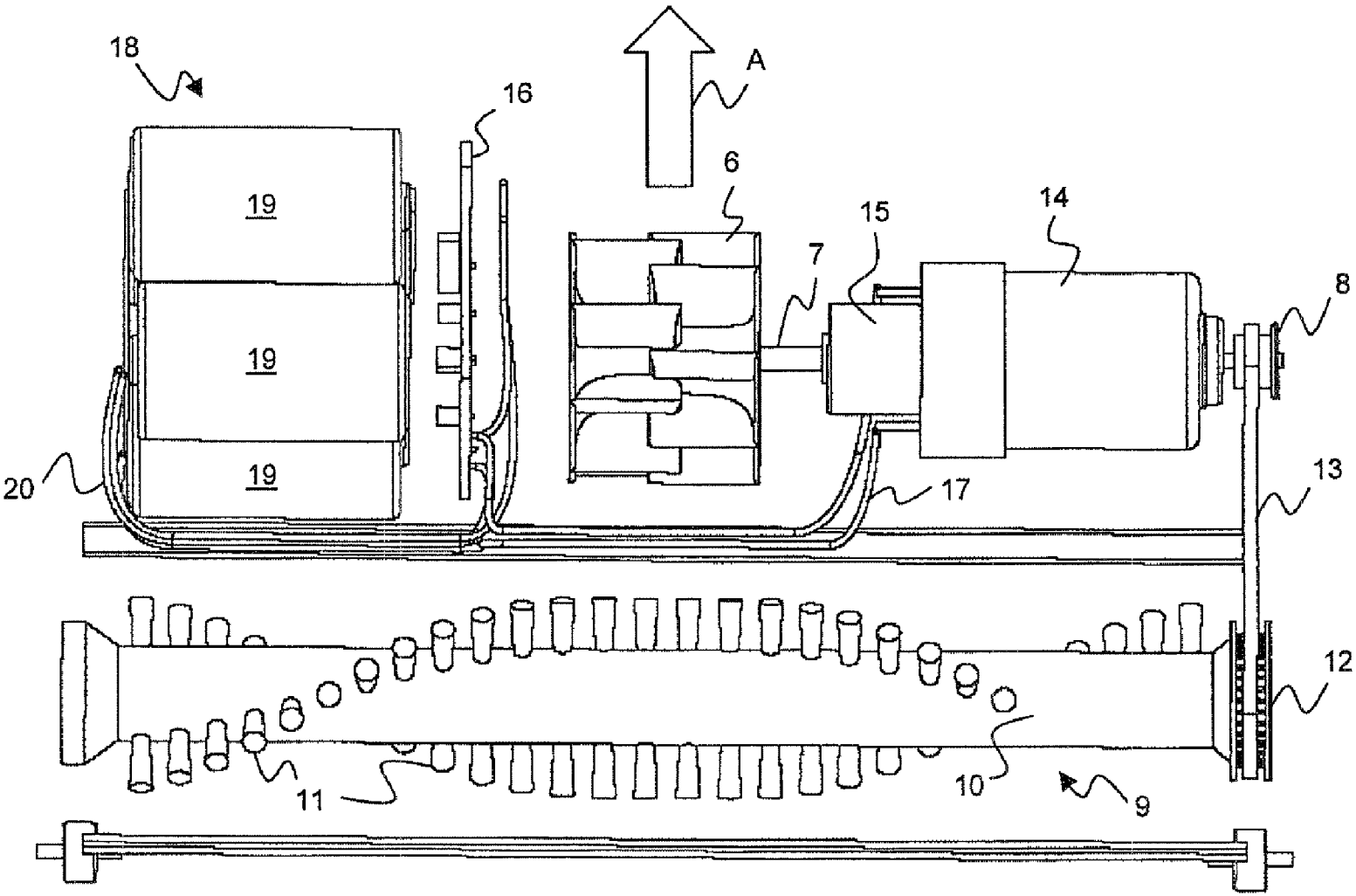
FIG. 2 is a perspective view at an angle different from that of FIG. 1 of a vacuum cleaner nozzle completely devoid of a housing so as to allow better viewing of the components.

A turbine 6 is mounted inside the housing 2 and is adapted to rotate around a shaft 7, the shaft 7 being arranged substantially transversely to the direction of travel of the suction air flow—indicated in FIG. 2 by the arrow "A"—which is intended to strike the vanes of the turbine 6 so as to cause it to rotate when the vacuum cleaner is operating.

The shaft 7 has an end which extends towards a side 102 of the housing 2 and on which a drive pulley 8 is keyed (or otherwise connected) so as to be rotationally integral with it.

Inside the housing 2, there is mounted a rotatable brush 9 which, preferably, comprises a cylindrical drum 10. The cylindrical drum 10 preferably supports a plurality of bristles 11 extending outwards, in a substantially radial direction, and it is adapted to rotate around a drum axis (not shown in the drawings) substantially parallel to the rotational shaft 7 of the turbine 6.

One end of the cylindrical drum 10 which is directed towards the above mentioned side 102 of the housing 2 supports a transmission pulley 12. A drive belt 13 is wound and tensioned between the transmission pulley 12 and the drive pulley 8, said belt 13 transmitting the movement of the turbine 6 to the rotatable brush 9.

A motor generator unit 14 is connected on the first shaft 7, more precisely between the drive pulley 8 and the turbine 6. The motor generator unit 14 is adapted to operate in a first mode (or generator mode), wherein it operates as an electric power generator, and in a second mode (or motor mode), wherein it operates as a motor for helping rotation of the rotatable brush 9, as will be described in further detail below.

The Applicant has performed some positive tests by using a motor generator unit Mabuchi RS550-PC 7.2 V, manufactured by MABUCHI MOTOR CO.LTD, based in Matsuhidai Matsudo City (Japan). This motor generator unit had an operating range between 6.0 V and 14.4 V, a speed of 16130 revolutions/minute at maximum efficiency and a torque of 47.8 mN·m at maximum efficiency.

Preferably, the motor generator unit comprises a DC motor, such as a permanent magnet motor. Alternatively, the motor generator unit may comprise an AC motor such as a brush motor.

Preferably, the motor generator unit 14 has, associated with it, an encoder 15, which is adapted to detect values of parameters indicative of the speed of rotation of the shaft 7, such as the number of revolutions per minute or the angular speed. The encoder 15 is also adapted to transmit the detected values to a processor of an electronic board 16. The electronic board 16 is connected to the encoder 15, for instance by means of a cable 17, as can be seen in FIGS. 1 and 2. The electronic board 16 preferably comprises a memory for storing predefined threshold values (a lower threshold value and an upper threshold value) for the parameters indicative of the speed of rotation of the first shaft 7, such as a lower and an upper threshold number of revolutions per minute or a lower and an upper threshold angular speed.

Figure 3B:
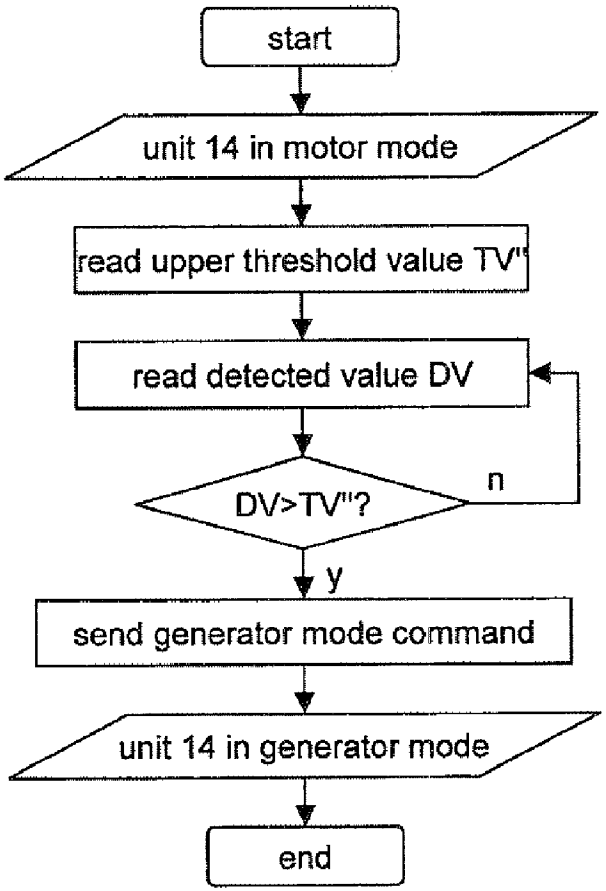
FIGS. 3*a* and 3*b* are schematic block diagrams showing operation of the electronic board comprised in the vacuum cleaner nozzle of FIGS. 1-2.
Figure 3A:
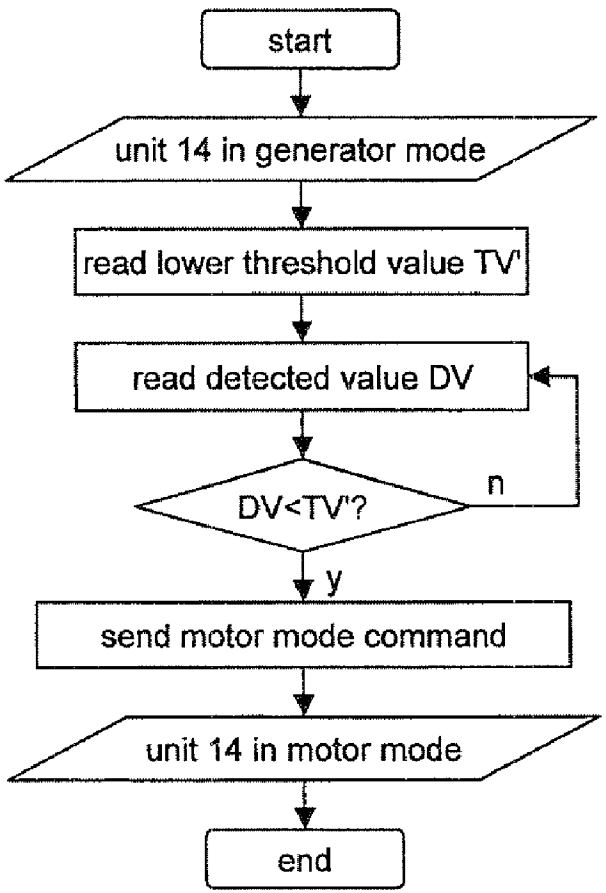

The electronic board 16 drives the operation of the motor generator unit 14. FIGS. 3*a* and 3*b* are basic flow charts of a possible operation of the electronic board 16.

By referring to FIG. 3*a*, it is assumed that the motor generator unit 14 is initially operating in the generator mode. When the values DV detected by the encoder 15 are lower than the lower threshold value TV', i.e. in the event of a significant deceleration in the rotation of the rotatable brush 9, owing to a large resistance caused by a brushed surface, the electronic board 16 sends a command signal to the motor generator unit 14 for switching it to its motor mode. So doing, the motor generator unit 14 starts to operate as a motor for supplying an additional rotational torque to the rotatable brush 9, as it will be explained in further detail herein.

By referring to FIG. 3*b*, it is now assumed that the motor generator unit 14 is operating in the motor mode. When the values DV detected by the encoder 15 are higher than the upper threshold value TV", i.e. in the event of a significant acceleration in the rotation of the rotatable brush 9, owing to a low resistance with the floor, the electronic board 16 sends a command signal to the motor generator unit 14 for switching it to its generator mode. So doing, the motor generator unit 14 starts to operate as a generator for supplying electric power to the accumulator unit 18. The motor generator unit 14 will continue to operate as a generator until the rotatable brush 9 experiences a large resistance caused by a brushed surface.

According to an alternative embodiment of the vacuum cleaner nozzle 1, in place of the encoder 15, a resistive torque detector can be mounted, for example, on the shaft 7, for detecting the values of resistive torque thereon and for transmitting them to the electronic board 16. In this embodiment, the memory of the electronic board 16 stores threshold values of the resistive torque, for causing switching of the operation of the motor generator unit 14.

The accumulator unit 18, for instance, may comprise at least one capacitor 19 (for instance, the embodiment shown in FIGS. 1 and 2 comprises three capacitors 19 connected in parallel), which is connected to the electronic board 16 and to the motor generator unit 14 by means of further cables 20.

More preferably, the at least one capacitor 19 comprises at least one ultracapacitor. The ultracapacitors are renowned for their characteristic of being able to be recharged very rapidly, in about a few tens of seconds, therefore, even where all the charge of power stored in them is used up, it is sufficient to raise the nozzle 1 for a few tens of seconds from the surface to be cleaned, while keeping the vacuum cleaner switched on, leaving the rotatable brush 9 to rotate without there being any resistance with the floor, so that it is able to resume the normal speed of rotation and number of revolutions: the electronic board detects this new condition and switches over the motor generator unit 14, converting it again into an electric power generator which, driven by the rotatable brush 9, recharges very rapidly the ultracapacitors 19, so that they are ready for use again.

For instance, the Applicant has performed some positive tests by using ultracapacitors produced by the company Maxwell Technologies SA, located in Rossens (Switzerland) having serial number BCAP0350. In an advantageous arrangement, three of said ultracapacitors have been used in parallel.

In one preferred embodiment the electronic board 16 is not powered by external power sources. Preferably, it is powered by the accumulator unit (possibly comprising one or more ultracapacitors). According to a preferred embodiment, when the turbine starts to rotate it switches (substantially automatically) the electronic board on and when the turbine stops rotating, the electronic board is switched off and it substantially automatically stops to operate. This is advantageous because the safety of the household appliance to which the nozzle is mounted becomes highly improved. There is no risk to have the rotatable brush rotating after unplugging from the main electric power. Therefore, in one preferred embodiment of the invention, the turbine operates as a switch for the operation of the rotatable brush. Contrarily to other state of the art nozzles, there is not a dedicated conventional switch for switching the rotation of the brush on/off.

The operating principle of the vacuum cleaner nozzle 1 according to the first embodiment is as follows. The nozzle 1 is mounted at the terminal end of a conventional suction tube which extends from a vacuum cleaner.

When the vacuum cleaner is switched on in order to clean a surface, a sucked air flow is generated and passes through the vacuum cleaner nozzle 1, passing from the first opening 3 to the second opening 4, striking the turbine 6 and causing rotation thereof.

Together with the turbine 6, the motor generator unit 14 and, via the drive belt 13 wound around the drive pulley 8 and the transmission pulley 12, the rotatable brush 9 are also made to rotate, said rotatable brush collecting the impurities from the surface to be cleaned and pushing them towards the first opening 3 so as to be sucked into the vacuum cleaner.

In these conditions, the motor generator unit 14 produces electric power which is stored by the accumulator unit 18, which becomes then charged.

In case the surface to be cleaned offers a high resistance, for example in case the surface is particularly rough or has pile of considerable length, the speed of rotation of the rotatable brush 9 becomes substantially reduced, until the number of revolutions per minute (or the angular speed) becomes smaller than the predetermined lower threshold value stored in the memory of the electronic board 16. The electronic board 16, in order to re-establish and maintain an effective action of the rotatable brush 9, switches operation of the motor generator unit 14, converting it into a motor which applies an additional rotational torque to the rotatable brush 9, which is added to rotational torque due to the turbine 6.

In this condition, the accumulator unit 18 feeds the motor generator unit 14 with the electric power stored previously until, if necessary, said power is used up.

FIGS. 4 to 9 show further embodiments of the suction cleaner nozzle of the present invention. Since such Figures are particularly intended for showing arrangements of the motor generator unit(s) and of the brush(es) relative to the turbine, the arrangement of the accumulator unit 18 and the switching board 16 in these Figures is only indicative. The encoder 15 is not shown in FIGS. 4 to 9.

Figure 4:
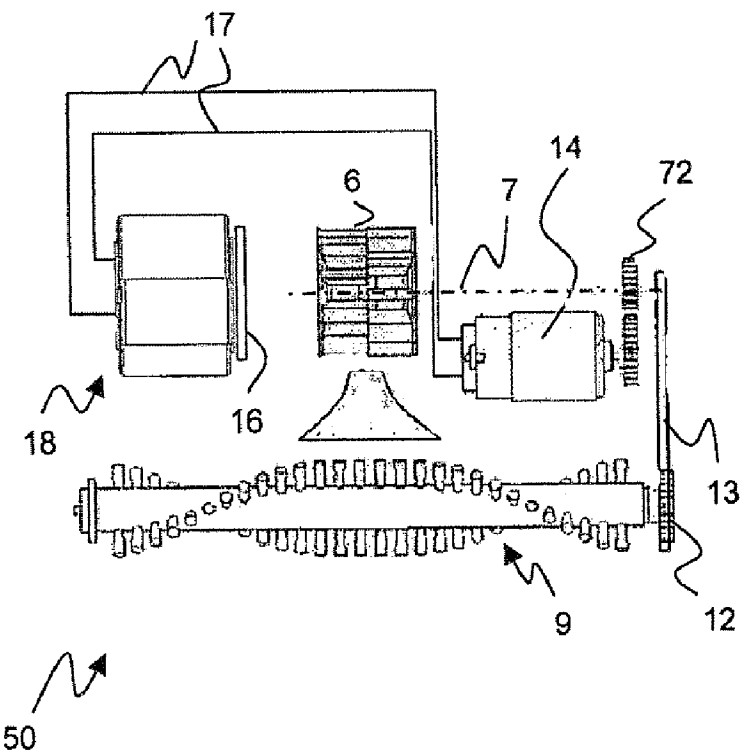
FIG. 4 is a schematic plane view of a vacuum cleaner nozzle according to a second embodiment of the present invention.

In particular, FIG. 4 shows a second embodiment of the suction cleaner nozzle of the present invention. The suction cleaner nozzle has been designated by reference number 50. It comprises a motor generator unit 14, a rotatable brush 9 and a turbine 6. The motor generator unit 14 is connected to the shaft 7 by means of a gearing 72. The gear ratio could be 1:1 or different from 1:1. Possibly, the gearing 72 is chosen so that the gear ratio is 2:1. Similarly to FIGS. 1, 2, a drive belt 13, a transmission pulley 12 and a drive pulley (not shown in FIG. 4) transmit the movement of the turbine 6 to the rotatable brush 9.

The operation of the vacuum cleaner nozzle 50 according to the first embodiment is substantially the same as the vacuum cleaner nozzle 1 of FIGS. 1 and 2, and therefore a full description of its operation will not be repeated.

Figure 5:
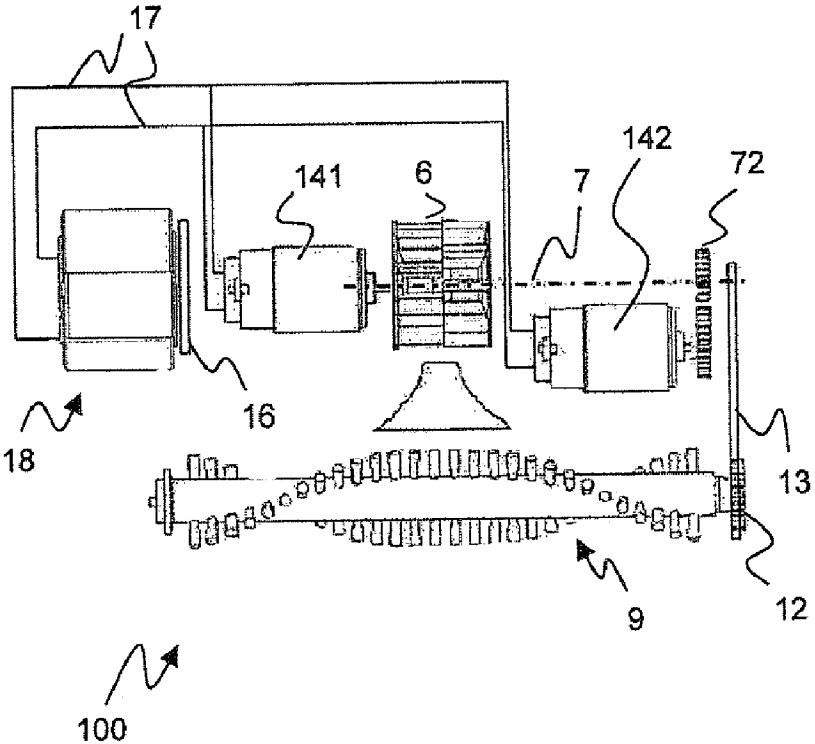
FIG. 5 is a schematic plane view of a vacuum cleaner nozzle according to a third embodiment of the present invention.

FIG. 5 shows a third embodiment of the suction cleaner nozzle of the present invention. The suction cleaner nozzle has been designated by reference number 100. It comprises a motor unit 141, a generator unit 142, a rotatable brush 9 and a turbine 6. The motor unit 141 and the generator unit 142 are keyed on, or otherwise connected to, the shaft 7 of the turbine 6, at opposite sides of the turbine 6. This is only exemplary, since the motor unit 141 and the generator 142 may also be arranged at a same side of the turbine 6. While the motor unit 141 is preferably directly connected to the shaft 7, the generator unit 142 is connected to the shaft 7 by means of a gearing 72. Preferably, the gear ratio is different from 1:1.

Preferably, the gearing 72 is chosen so that the gear ratio is comprised between 1:3 and 3:1. Similarly to FIGS. 1, 2, a drive belt 13, a transmission pulley 12 and a drive pulley (not shown in FIG. 5) transmit the movement of the turbine 6 to the rotatable brush 9.

The operating principle of the vacuum cleaner device 100 is as follows.

In a first operation mode, the sucked air flow passing through the vacuum cleaner nozzle 100 causes rotation of the turbine 6. Together with the turbine 6, the generator unit 141 and the rotatable brush 9 are also caused to rotate. In these conditions, the generator unit 141 produces electric power. The so produced electric power is stored by the accumulator unit 18, which becomes therefore charged. At such first operation mode, the motor unit 142 remains standing or it turns idle according to the commands received from the electronic board.

In a second operation mode (for example, during use of the vacuum cleaner on rugs or carpets with long pile), in case the speed of rotation of the rotatable brush 9 is reduced until the number of revolutions per minute becomes lower than the predetermined lower threshold value, the electronic board 16 commands to activate the motor unit 142 for applying an additional rotational torque to the rotatable brush 9. In this second operation mode, the accumulator unit 18 provides the motor unit 142 with the electric power stored previously therein.

Preferably, the generator unit 141 and the motor unit 142 are implemented by using a first motor generator unit 141 and a second motor generator unit 142, substantially similar to the above cited motor generator unit 14 employed into the first and second embodiments of the present invention. In this case, in the first operation mode, the electronic board sends a command signal to the first motor generator unit 141 for switching it to its generator mode. At such first operation mode, the second motor generator unit 142 remains standing or it turns idle according to the commands received from the electronic board. Besides, in the second operation mode, the electronic board sends a command signal to the second motor generator unit 142 for switching it to its motor mode. At such second operation mode, the first motor generator unit 141 remains standing or it turns idle according to the commands received from the electronic board.

According to an alternative embodiment of the present invention, in place of the generator unit 141 of FIG. 5 a motor unit can be arranged. Similarly, in place of the motor unit 142 of FIG. 5 a generator unit can be arranged. Again, in a first operation mode, the sucked air flow passing through the vacuum cleaner nozzle 100 causes rotation of the turbine 6. Together with the turbine 6, the generator unit and the rotatable brush 9 are also caused to rotate. In these conditions, the generator unit produces electric power. The so produced electric power is stored by the accumulator unit 18, which becomes therefore charged. In a second operation mode, the electronic board commands to activate the motor unit for applying an additional rotational torque to the rotatable brush 9. In this second operation mode, the accumulator unit 18 feeds power to the motor unit. Again, preferably, the motor unit 141 and the generator unit 142 are implemented by using a first motor generator unit 141 operating in its motor mode at the second operation mode of the vacuum cleaner nozzle and a second motor generator unit 142 operating in its generator mode at the first operation mode of the vacuum cleaner nozzle.

Figure 6:
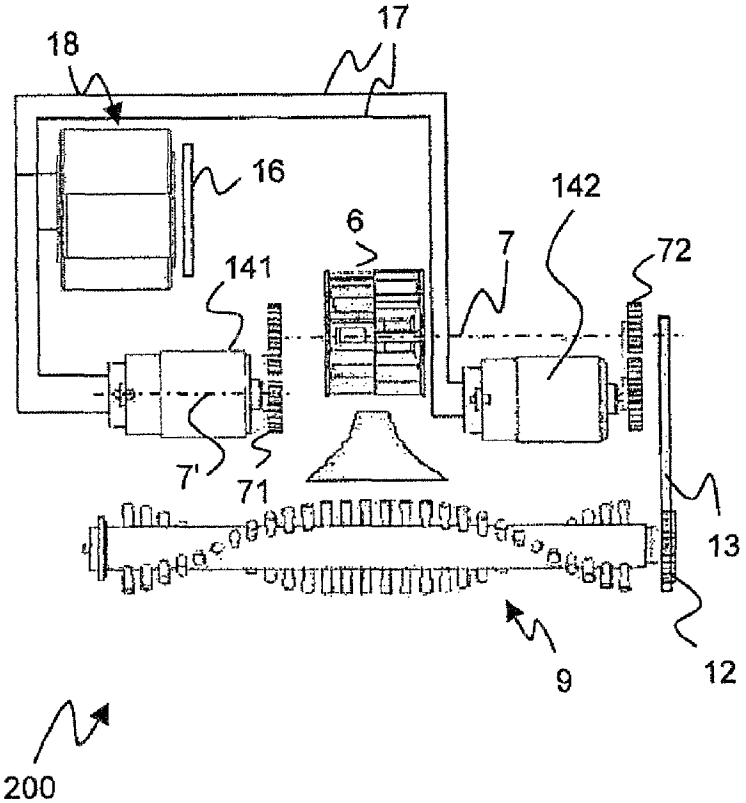
FIG. 6 is a schematic plane view of a vacuum cleaner nozzle according to a fourth embodiment of the present invention.

FIG. 6 shows a fourth embodiment of the suction cleaner nozzle of the present invention, which is substantially similar to the first embodiment 100 shown in FIG. 4. The nozzle has been designated by reference number 200. The main difference between the nozzle 100 of FIG. 4 and the nozzle 200 of FIG. 6 is that in FIG. 6 both the generator unit 141 and the motor unit 142 are keyed on (or otherwise connected to) the shaft 7 of the turbine 6 by means of respective gearings 71, 72. Therefore, both the first gear ratio between the shaft 7 and the generator unit 141 and the second gear ratio between the shaft 7 and the motor unit 142 are preferably different from 1:1. Preferably, the gearings 71, 72 are chosen so that the first and second gear ratios are comprised between 1:3 and 3:1. The first and the second gear ratios may be either equal or not. Again, although in FIG. 6 the generator unit 141 and the motor unit 142 are arranged at opposite sides of the turbine 6, according to other embodiments not shown in the drawings, units 141 and 142 may be arranged differently, for instance they could be arranged at a same side of the turbine 6. Again, preferably, the generator unit 141 and the motor unit 142 are implemented by using a first motor generator unit 141 operating in its generator mode at the first operation mode of the vacuum cleaner nozzle and a second motor generator unit 142 operating in its motor mode at the second operation mode of the vacuum cleaner nozzle.

The operation of the vacuum cleaner nozzle 200 according to the fourth embodiment is substantially the same as the vacuum cleaner nozzle 100 of the third embodiment and therefore a full description of its operation will not be repeated.

According to an alternative embodiment of the present invention, in place of the generator unit 141 of FIG. 6 a motor unit can be arranged. Similarly, in place of the motor unit 142 of FIG. 6 a generator unit can be arranged. The operation of such an alternative embodiment is the same as the operation of the alternative embodiment described in connection with FIG. 5

Figure 7:
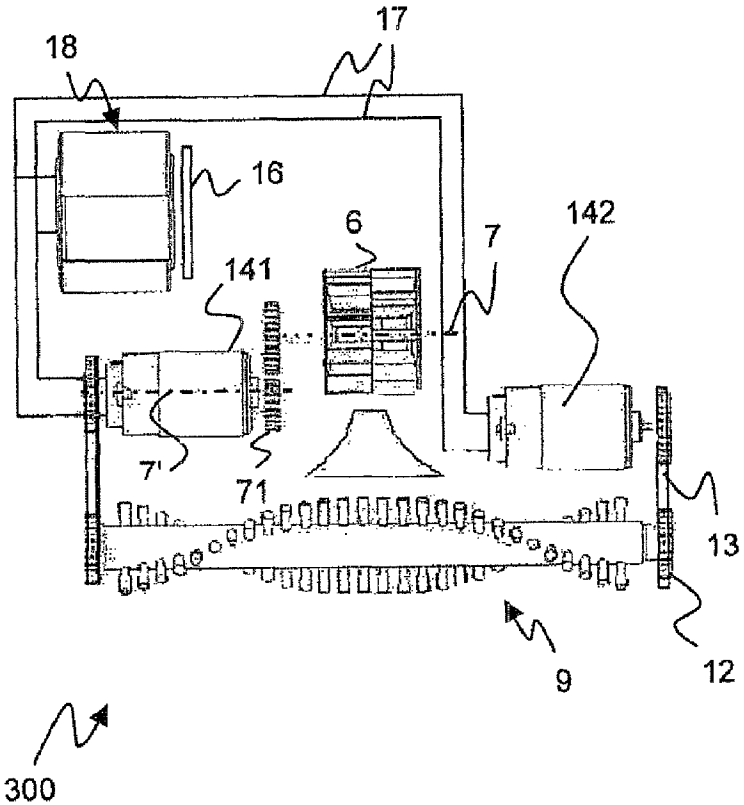
FIG. 7 is a schematic plane view of a vacuum cleaner nozzle according to a fifth embodiment of the present invention.

FIG. 7 shows a fifth embodiment of the suction cleaner nozzle of the present invention which has been designated by reference number 300. The nozzle 300 comprises a generator unit 141, a motor unit 142, a rotatable brush 9 and a turbine 6. Differently from nozzle 100 and 200, only the generator unit 141 is connected to the shaft 7 of the turbine 6 by means of a gearing 71. Preferably, the gearing 71 is chosen so that the gear ratio is comprised between 1:3 and 3:1. Moreover, the generator unit 141 has a rotational shaft 7', which is preferably parallel to the shaft 7 of the turbine 6. The rotational shaft 7' of the generator unit 141 has an end which extends towards a side of the housing 2. A drive pulley 8 is preferably keyed at such end so as to be rotationally integral with it. Similarly to FIGS. 1 and 2, a drive belt 13, a transmission pulley 12 and the drive pulley 8 transmit the movement of the turbine 6 (and then of the generator unit 141) to the rotatable brush 9. Besides, the motor unit 142 is connected to the rotatable brush 9 by means of a drive belt 13', a transmission pulley 12' and a drive pulley 8' which transmit the movement of the motor unit 142 to the rotatable brush 9. The operation of the vacuum cleaner nozzle 300 is as follows.

In a first operation mode, the sucked air flow passing through the vacuum cleaner nozzle 300 causes rotation of the turbine 6. Together with the turbine 6, the generator unit 141 and the rotatable brush 9 are also caused to rotate. In these conditions, the generator unit 141 produces electric power which is stored by the accumulator unit 18, which becomes therefore charged.

In a second operation mode (for example, during use of the vacuum cleaner on rugs or carpets with long pile), in case the speed of rotation of the rotatable brush 9 is reduced until the number of revolutions per minute becomes smaller than the predetermined lower threshold value, the electronic board 16 commands to activate the motor unit 142 for applying an additional rotational torque to the rotatable brush 9. In this second operation mode, the accumulator unit 18 then transmits to the motor unit 142 the electric power stored previously until, if necessary, said power is used up.

Again, preferably, the generator unit 141 and the motor unit 142 are implemented by using a first motor generator unit 141 operating in its generator mode at the first operation mode of the vacuum cleaner nozzle and a second motor generator unit 142 operating in its motor mode at the second operation mode of the vacuum cleaner nozzle.

According to an alternative embodiment of the present invention, in place of the generator unit 141 of FIG. 7 a motor unit can be arranged. Similarly, in place of the motor unit 142 of FIG. 7 a generator unit can be arranged. Again, in a first operation mode, the sucked air flow passing through the vacuum cleaner nozzle 300 causes rotation of the turbine 6. Together with the turbine 6, the generator unit and the rotatable brush 9 are also caused to rotate. In these conditions, the generator unit produces electric power. The so produced electric power is stored by the accumulator unit 18, which becomes therefore charged. In a second operation mode, the electronic board commands to activate the motor unit for applying an additional rotational torque to the rotatable brush 9. In this second operation mode, the accumulator unit 18 feeds power to the motor unit.

Other embodiments of the suction cleaner nozzle according to the present invention may also comprise more than one rotatable brush 9.

Figure 8:
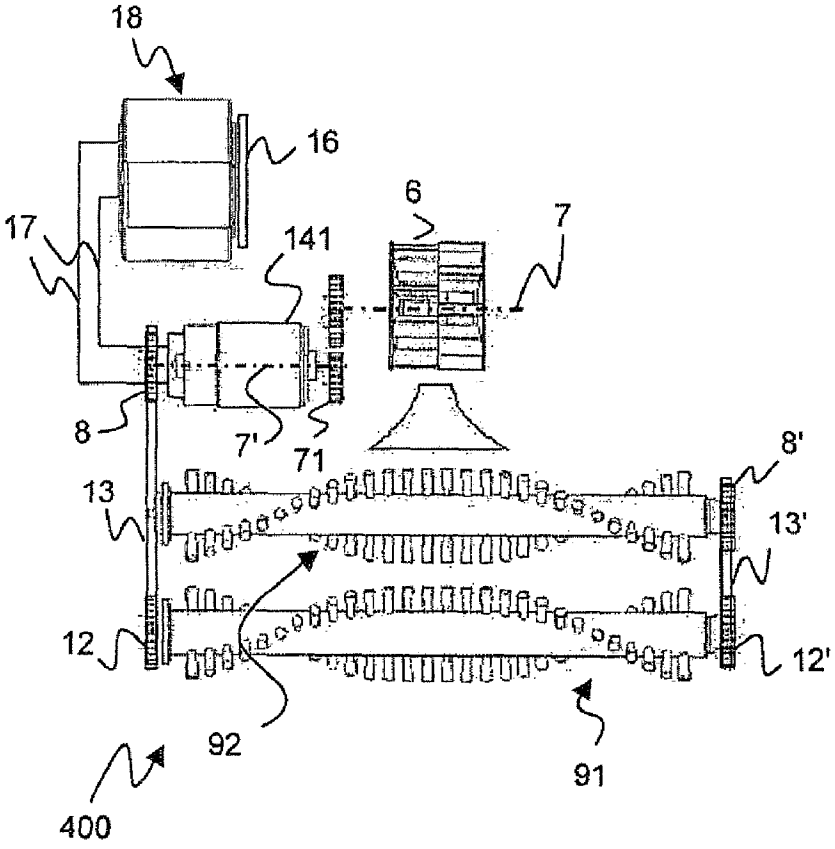
FIG. 8 is a schematic plane view of a vacuum cleaner nozzle according to a sixth embodiment of the present invention.

For instance, FIG. 8 shows a sixth embodiment of the suction cleaner nozzle of the present invention which has been designated by reference number 400. The suction cleaner nozzle 400 comprises a single motor generator unit 14, a first rotatable brush 91, a second rotatable brush 92 and a turbine 6. The motor generator unit 14 is keyed on (or otherwise connected to) the shaft 7 of the turbine 6, by means of a gearing 71. Preferably, the gearing 71 is chosen so that the gear ratio is comprised between 1:3 and 3:1. Preferably, the motor generator unit 14 has a rotational shaft 7', which is preferably parallel to the shaft 7 of the turbine 6. The rotational shaft 7' has an end which extends towards a side of the housing 2 and on which a drive pulley 8 is preferably keyed so as to be rotationally integral with it. Similarly to FIGS. 1 and 2, a drive belt 13, a transmission pulley 12 and the drive pulley 8 transmit the movement of the turbine 6 (and then of the unit 14) to the first rotatable brush 91. Besides, a drive pulley 12', a drive belt 13' and a transmission pulley 8' transmit the movement of the first rotatable brush 91 to the second rotatable brush 92, in such a way that the first and second rotatable brushes 91 and 92 have opposite rotation directions. Alternatively, the first and second rotatable brushes 91, 92 may have the same rotation direction.

In a first operation mode, the sucked air flow passing through the vacuum cleaner nozzle 400 causes rotation of the turbine 6. Together with the turbine 6, the motor generator unit 14, the first rotatable brush 91 and the second rotatable brush 92 are also made to rotate. In these conditions, the motor generator unit 14 produces electric power which is stored by the accumulator unit 18, which becomes then charged.

In a second operation mode (for example, during use of the vacuum cleaner on rugs or carpets with long pile), in case the speed of rotation either of the first or the second rotatable brush 91, 92 is reduced until the number of revolutions per minute becomes lower than the predetermined minimum value, the electronic board switches operation of the motor generator unit 14, converting it into a motor for applying an additional rotational torque to the first rotatable brush 91, and then to the second rotatable brush 92. In this condition, the accumulator unit 18 transmits to the motor generator unit 14 the electric power stored previously until, if necessary, said power is used up.

The single motor generator unit can be replaced, in other embodiments that are not shown, by a motor unit and a separate generator unit similarly to the arrangements of FIGS. 5, 6 and 7. In this case, preferably, the motor unit and the generator unit are implemented by using a first motor generator unit operating in its generator mode at the first operation mode of the vacuum cleaner nozzle and a second motor generator unit operating in its motor mode at the second operation mode of the vacuum cleaner nozzle.

Figure 9:
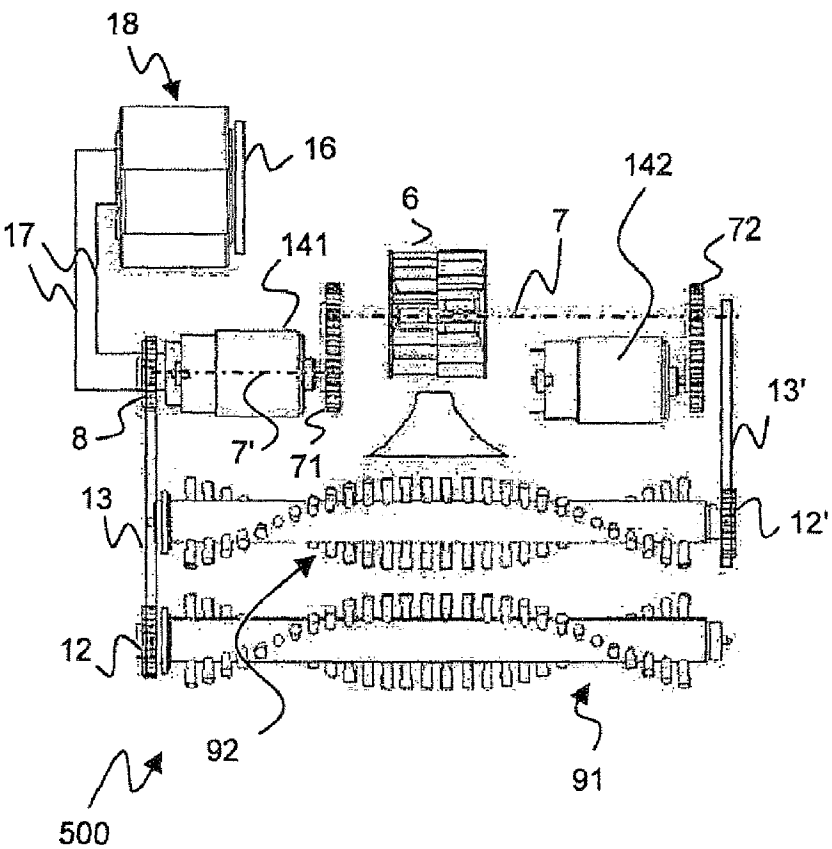
FIG. 9 is a schematic plane view of a vacuum cleaner nozzle according to a seventh embodiment of the present invention

FIG. 9 shows a seventh embodiment of the suction cleaner nozzle of the present invention which has been designated by reference number 500. The suction cleaner nozzle 500 comprises a generator unit 141, a motor unit 142, a first rotatable brush 91, a second rotatable brush 92 and a turbine 6. Both the generator unit 141 and the motor unit 142 are connected to the shaft 7 of the turbine 6, by means of respective gearings 71, 72. Preferably, the gear ratio between the shaft 7 and the generator unit 141 and the gear ratio between the shaft 7 and the motor unit 142 is different from 1:1. Preferably, the gearings 71 and 72 are chosen so that the first and second gear ratios are comprised between 1:3 and 3:1. The gear ratios may be either equal or not.

Moreover, the generator unit 141 has a rotational shaft 7' with an end which extends towards a side of the housing 2 and on which a drive pulley 8 is keyed (or otherwise connected) so as to be rotationally integral with it. A drive belt 13, a transmission pulley 12 and the drive pulley 8 transmit the movement of the turbine 6 (and then of the generator unit 141) to the first rotatable brush 91. Besides, a transmission pulley 12', a drive belt 13' and a drive pulley (not shown) transmit the movement of the motor unit 142 to the second rotatable brush 92, in such a way that the first and second rotatable brushes 91 and 92 have opposite rotation directions. Alternatively, the first and second rotatable brushes 91, 92 may have the same rotation direction.

In a first operation mode, the sucked air flow passing through the vacuum cleaner nozzle 500 causes rotation of the turbine 6. Together with the turbine 6, the generator unit 141, the first rotatable brush 91 and the second rotatable brush 92 are also made to rotate. In these conditions, the generator unit 141 produces electric power which is stored by the accumulator unit 18, which becomes then charged. At such first operation mode, the motor unit 142 remains standing or it turns idle according to the commands received from the electronic board.

In a second operation mode (for example, during use of the vacuum cleaner on rugs or carpets with long pile), in case the speed of rotation either of the first or the second rotatable brush 91, 92 is reduced until the number of revolutions per minute becomes lower than the predetermined minimum value, the electronic board commands to activate the motor unit 142 for applying an additional rotational torque to the second rotatable brush 92. In this second operation mode, the accumulator unit 18 then transmits to the motor unit 142 the electric power stored previously until, if necessary, said power is used up.

Again, preferably, the generator unit 141 and the motor unit 142 are implemented by using a first motor generator unit 141 operating in its generator mode at the first operation mode of the vacuum cleaner nozzle and a second motor generator unit 142 operating in its motor mode at the second operation mode of the vacuum cleaner nozzle.

The nozzle according to the present invention results in a number of advantages over the prior art nozzles, some of them have been mentioned above.

Profitably, when ultracapacitors are used, the nozzle has an exceptionally long operation life. As said above, in addition, ultracapacitors are able to recharge very rapidly.

The nozzle according to the present invention results in lower environmental impact because there are no rechargeable batteries (presently Ni-Mh or NICd) to be wasted.

Conventional devices for recharging the rechargeable batteries are not necessary.

No connection to power lines separated from the nozzle should be provided and the operation costs are low. In fact, the nozzle according to the present invention should be fed only with the electric power which is necessary for powering the main motor of the vacuum cleaner. Profitably, the turbine could operate as a switch for the brush as set forth above.

In the known nozzles provided only with a turbine for turning the rotatable brush the brushing efficiency is only dependent from the power of the main motor of the vacuum cleaner. Therefore, vacuum cleaner provided with low power motors obtain low brushing effect. In the nozzle according to the present invention, the brushing efficiency does not only depend on the power of the main motor but also on the characteristics of the nozzle motor which is powered by the accumulator unit. Therefore, the nozzle according to the invention results in valuable results also when connected to a low power vacuum cleaner.

Again, thanks to the absence of electric connections outside the nozzle, different power requirements, often dependent from the country where the vacuum cleaner has to be used, are overcome.

The nozzle according to the present invention is profitably usable in connection with conventional household use vacuum cleaners and/or with vacuum cleaners for industrial use. Advantageously, it can be also used in centralized vacuum cleaners. In such vacuum cleaners, especially when they are installed in large buildings, the suction is rather low and this does not allow the use of turbine powered rotatable brushes.

A further possible use of the nozzle according to the present invention is in connection with water filtering vacuum cleaners, steam injection and suction appliances or with the so called wet & dry appliances. Generally these kinds of vacuum cleaners are not allowed to use conventional 230V or 130V powered nozzles for safety reasons.

Therefore, for the purposes of the present invention, the term "vacuum cleaner" as used in the present description and in the claims will comprise any device of the group comprising: household use vacuum cleaners, vacuum cleaners for industrial use, vertical vacuum cleaners, centralized vacuum cleaners, water filtering vacuum cleaners, steam injection and suction appliances, back-pack vacuum cleaners, belt vacuum cleaners, electric brooms, wet & dry appliances, wall mounted appliances or the like. Similarly, the term "vacuum cleaner nozzle" should be intended as a nozzle for use in connection with any of the above vacuum cleaners.

The invention claimed is:

1. A vacuum cleaner nozzle, comprising:
- a housing;
- a rotatable brush which is adapted to brush a surface; and
- a turbine, wherein a suction air flow impacting on said turbine generates a first rotational torque for rotating said rotatable brush wherein it further comprises:
  - an electric power generator for generating electric power by a rotation of said turbine;
  - an accumulator unit for storing said electric power; and
  - an electric motor which is adapted to generate a second rotational torque for rotating said rotatable brush, wherein said electric motor is electrically connected to said accumulator unit.

2. The nozzle of claim 1, wherein said electric power generator and said electric motor are integrated into a single component.

3. The nozzle of claim 1, wherein said electric power generator and said electric motor are separated components.

4. The nozzle of claim 1, wherein said electric power generator and said electric motor are substantially identical devices.

5. The nozzle of claim 1, further comprises a detector device for detecting values (DV) of at least one parameter indicative of the rotation of said rotatable brush.

6. The nozzle of claim 5, wherein said detector device comprises an encoder and wherein said at least one parameter comprises a number of revolutions per time unit and/or an angular speed of said turbine.

7. The nozzle of claim 5, wherein said detector device comprises a resistive torque detector and wherein said at least one parameter comprises a resistive torque on said turbine.

8. The nozzle of claim 5, further comprises a switching device for switching between a first operation mode and a second operation mode, wherein in the first operation mode said electric power generator generates electric power which is stored in said accumulator unit.

9. The nozzle of claim 8, wherein in the second operation mode said electric motor is working, fed by said electric power.

10. The nozzle of claim 8, wherein said switching device is adapted to store a first threshold value (TV') and a second threshold value (TV") of said parameter indicative of the rotation of said rotatable brush.

11. The nozzle of claim 10, wherein said switching device is adapted to compare said plurality of detected values (DV) of said at least one parameter with said first threshold value (TV') and said second threshold value (TV") and to switch between said first operation mode and said second operation mode according to results of said comparing.

12. The nozzle of claim 1, wherein said electric power generator and said motor are separated components which are connected to a shaft of said turbine at opposite sides of said turbine.

13. The nozzle of claim 1, wherein at least one of said electric power generator and said electric motor is arranged with its axis parallel to a shaft of said turbine, and it is connected to said shaft by means of a gearing.

14. The nozzle of claim 13, wherein the gear ratio between said at least one of said electric power generator and said electric motor and said shaft is comprised between 1:3 and 3:1.

15. The nozzle of claim 1, wherein said accumulator unit comprises at least one capacitor.

16. The nozzle of claim 15, wherein said accumulator unit comprises at least one ultracapacitor.

17. The nozzle of claim 1, also comprises a further rotatable brush.

18. The nozzle of claim 17, wherein said rotatable brush and said further rotatable brush have a same rotation direction.

19. The nozzle of claim 17, wherein said rotatable brush and said further rotatable brush have opposite rotation directions.

20. A vacuum cleaner nozzle comprising:
- a housing,
- a rotatable brush which is adapted to brush a surface, and
- a turbine, wherein a suction air flow impacting on said turbine generates a first rotational torque for rotating said rotatable brush, wherein it further comprises:
  - a motor generator unit which is adapted to generate electric power by a rotation of said turbine when it operates in generator mode and to generate a second rotational torque for rotating said rotatable brush when it operates in motor mode; and
  - an accumulator unit for storing said electric power generated by the motor generator unit in its motor mode; wherein said motor generator unit is electrically connected to said accumulator unit.

21. A vacuum cleaner, further comprising a vacuum cleaner nozzle according to claim 1.

* * * * *